US007340988B2

(12) United States Patent
Vicentini

(10) Patent No.: US 7,340,988 B2
(45) Date of Patent: Mar. 11, 2008

(54) HYDRAULIC MACHINE HAVING AXIAL PISTONS WITH A SYNCHRONIZATION SYSTEM

(75) Inventor: Gilles Vicentini, Compiegne (FR)

(73) Assignee: Poclain Hydraulics, Verberie (FR)

( * ) Notice: Subject to any disclaimer, the term of this patent is extended or adjusted under 35 U.S.C. 154(b) by 164 days.

(21) Appl. No.: 11/397,755

(22) Filed: Apr. 4, 2006

(65) Prior Publication Data

US 2006/0218786 A1 Oct. 5, 2006

(30) Foreign Application Priority Data

Apr. 5, 2005 (FR) ..... 0503345

(51) Int. Cl.
*F01B 13/04* (2006.01)

(52) U.S. Cl. ..... 92/57; 92/71; 91/499

(58) Field of Classification Search ..... 92/57, 92/71; 91/499; 417/269

See application file for complete search history.

(56) References Cited

U.S. PATENT DOCUMENTS 3,366,968 A * 1/1968 Iseman ..... 92/71

7,013,791 B2 * 3/2006 Galba ..... 91/499

FOREIGN PATENT DOCUMENTS

| | | |
|---|---|---|
| GB | 21424 | 5/1911 |
| GB | 522453 | 6/1940 |
| GB | 1140167 | 5/1967 |
| WO | WO2005/078238 | 8/2005 |

* cited by examiner

*Primary Examiner*—Michael Leslie
(74) *Attorney, Agent, or Firm*—Ladas & Parry LLP

(57) ABSTRACT

The hydraulic machine having axial pistons comprises: a cylinder block mounted to rotate about a first axis of rotation; and a swash plate supporting a sliding disk in rotation about a second axis of rotation which is inclined relative to the first axis of rotation. Coupling rods are connected to the pistons via first spherical joints and to the sliding disk via second spherical joints. For each coupling rod, a synchronization system for providing synchronization between the cylinder block and the sliding disk has two drive surfaces stationary respectively relative to the coupling rod and relative to the sliding disk, the second drive surface being off-center relative to the second spherical joint of the rod, such that a reference amount of clearance between said second drive surface and a first drive surface is small in the zone in which said surfaces come into contact at the time of synchronization in the preferred direction of rotation.

15 Claims, 5 Drawing Sheets

HYDRAULIC MACHINE HAVING AXIAL PISTONS WITH A SYNCHRONIZATION SYSTEM

FIELD OF THE INVENTION

The present invention relates to a hydraulic machine having axial pistons, such as a motor or a pump, comprising:

- a cylinder block mounted in a casing to rotate about a first axis of rotation in a preferred direction of rotation, the cylinder block comprising a plurality of cylinders in which pistons are mounted to move in translation parallel to the first axis of rotation;
- a swash plate supporting a sliding disk suitable for being driven, relative to the swash plate, in rotation about a second axis of rotation which is inclined relative to the first axis of rotation;
- coupling rods for coupling together the sliding disk and the pistons, each coupling rod being connected firstly to a piston via a first spherical joint and secondly to the sliding disk via a second spherical joint; and
- a synchronization system for providing synchronization between the cylinder block and the sliding disk which, for each coupling rod, has a first drive surface that is stationary relative to the coupling rod and that is suitable for coming into contact with a second drive surface that is stationary relative to the sliding disk, clearance being provided between said first and second drive surfaces.

BACKGROUND OF THE INVENTION

GB 1,140,167 discloses a machine of that type, in which the synchronization system comprises a drive part that is stationary relative to the sliding disk and that, for each coupling rod, presents a recess through which the coupling rod passes, said recess being in the form of a radial slot that is open onto the outer periphery of the drive part. While the cylinder block is rotating, the coupling rod that passes through a recess comes intermittently into contact with the faces of the slot that forms the recess, thereby making it possible to hold said rod in a position such that its axis is approximately contained in a normal radial plane, containing the second axis of rotation and a radius extending from said axis and passing through the center of the second spherical joint corresponding to said rod. Thus, the axis of each coupling rod is held approximately in a normal radial plane, so that the rotation of the sliding disk about the second axis of rotation is synchronized with the rotation of the cylinder block about the first axis.

The time taken for synchronization, between the moment when, under the effect of the cylinder block rotating, a coupling rod tends to depart from a position in which its axis is contained in the normal radial plane that contains the center of its second spherical joint and the moment when such departure is countered by the contact between the rod and a face of the slot, thereby holding the axis of said rod approximately in said normal radial plane, is a function of the respective dimensions of the slot and of the rod engaged therein. More precisely, said time depends on the reference clearance between the first drive surface formed on the rod and the second drive surface formed by the wall of the slot, said reference clearance being the clearance that is measured between said surfaces when the axis of the coupling rod is in its normal radial plane.

In GB 1,140,167, the slots in the drive part serve to accommodate the tangential movements of the coupling rods, but, insofar as said slots are open onto the outer periphery of the drive part, said tangential movements are not limited when the radial movements increase.

In the description below, the tangential direction is considered to be the direction that is tangential to the circle described by the centers of the second spherical joints whereas the radial direction is the direction that is radial relative to said circle.

Patent Application PCT/EP2004001560 (published as WO2005/078238) discloses a synchronization system in which the first and second drive surfaces are each formed by rotating a generator line about an axis and are thus "surfaces of revolution" or "rotational surfaces". As is explained in that patent application, this feature makes it possible to reduce the synchronization times by limiting the distance between a first drive surface and the corresponding second drive surface.

As indicated above, the synchronization system serves to hold the axis of each coupling rod approximately in its normal radial plane, i.e. to ensure that the centers of the second spherical joints are positioned correctly and to reduce the forces acting on the coupling rods.

For each coupling rod, clearance is necessary between the first drive surface and the second drive surface. While the cylinder block is rotating, the coupling rod tends to pivot relative to the center of the first spherical joint. This tendency to pivot results from the fact that the second axis of rotation is inclined relative to the first axis of rotation. The centers of the first spherical joints are disposed on a first circle centered on the first axis of rotation and contained in a plane perpendicular to said axis, whereas the centers of the second spherical joints are disposed on a second circle centered on the second axis of rotation and contained in another plane perpendicular to said axis. Due to the inclination between said axes, the projection of the first circle onto the plane containing the second circle forms an ellipse. As a result, while the cylinder block is rotating, the axis of each coupling rod substantially describes a cone whose vertex is at the center of the second spherical joint, assuming that the axis of the coupling rod is a straight line passing through the centers of the first and second spherical joints.

Thus, while the cylinder block is rotating, the first and second coupling surfaces come intermittently into contact with one another. If it is considered that a coupling rod is initially in a position in which its axis is in its normal radial plane, the rotation of the cylinder block tends to tilt the rod which thus moves away from this initial position until the first drive surface comes into contact with the second drive surface, thus tending to constrain the cylinder block and the sliding disk to rotate together instantaneously, and thus to synchronize them.

The angle between the axis of the coupling rod and the second axis of rotation is designated by angle $\beta$ below.

With the synchronization system, the aim is for the angle of inclination $\beta$ of the coupling rods to remain small, while accommodating the angular movements of the coupling rods that are necessary, as indicated above, due to them pivoting relative to the centers of the first spherical joints.

For a coupling rod under consideration, the angle $\beta$ varies while the cylinder block is rotating. The distance between the second drive surface and the first drive surface is such that said second drive surface comes periodically into contact with the second drive surface, when the angle $\beta$ reaches a value such that said contact is established. The force exerted by the second drive surface on the first surface during said contact is referred to below as the "synchronization force".

The synchronization forces depend on the clearance between the drive surfaces, on the angle of inclination of the swash plate, i.e. on the angle of inclination between the second axis of rotation and the first axis of rotation, and on the elasticity of the material of which the coupling rods are made.

OBJECTS AND SUMMARY OF THE INVENTION

An object of the present invention is to improve the above-mentioned state of the art, by proposing a synchronization system making it possible to reduce the synchronization forces, and therefore, to reduce the stresses exerted on the coupling rods.

This object is achieved by means of the fact that the second drive surfaces are off-center relative to the second spherical joints such that a reference amount of clearance between a second drive surface and a first drive surface is small in the zone in which said surfaces come into contact at the time of synchronization in the preferred direction of rotation.

If a particular coupling rod is considered, while the axis of said rod is in its normal radial plane, the reference clearance between the first drive surface associated with said rod and the second drive surface associated with the sliding disk can be seen. If, starting from this situation, the fluid feed to the cylinders is such that the cylinder block rotates in its preferred direction of rotation, said coupling rod tends to tilt relative to the second axis of rotation at the above-mentioned angle β, until synchronization is established for said rod, i.e. until the first drive surface comes into contact with the second drive surface.

In the invention, the second drive surfaces are off-center relative to the second spherical joints, so that said synchronization occurs more rapidly than in the prior art, in which such eccentricity does not exist. Overall, the reference clearance is naturally sufficient to accommodate the necessary movement of the coupling rod, but it is locally small by means of said eccentricity, and synchronization contact is thus established more rapidly, before the angle β reaches a large value, which makes it possible to reduce very significantly the synchronization force at the time of the synchronization.

It should be noted that the invention applies both to synchronization systems using slots having plane side faces as described in GB 1,140,167, and also to synchronization systems in which the drive surfaces are rotational surfaces, as described in PCT/EP2004001560. The invention applies generally to synchronization systems whose drive surfaces have outlines that are closed or open, outlines that are purely rotational, or that locally present flats.

The eccentricity is measured between the geometrical center of a first drive surface and the geometrical center of a second drive surface, in the same plane perpendicular to the second axis of rotation, in a reference position in which the axis of the coupling rod, which axis is a straight line passing through the centers of the spherical joints, is parallel to said axis of rotation. For a surface having constant curvature, the geometrical center is the center of curvature of the curve that said surface forms in section perpendicular to the normal axis, passing through the center of the second spherical joint and parallel to the second axis of rotation. If either of the drive surfaces is not purely a rotational surface, its center is then a center of symmetry.

Advantageously, relative to the second spherical joints, the second drive surfaces present tangential eccentricity measured, for each second spherical joint, tangentially to the circle described by the center of said second spherical joint while the sliding disk is rotating about the second axis of rotation.

The tangential component of the synchronization forces is larger. The eccentricity of the invention, thus preferably includes a tangential component.

Advantageously, relative to the second spherical joints, the second drive surfaces also present radial eccentricity measured, for each second spherical joint, on a radius of the circle described by the center of said second spherical joint while the sliding disk is rotating about the second axis of rotation.

This radial eccentricity is also advantageous, in particular when the drive surfaces are rotational surfaces of the type described in Patent Application PCT/EP2004001560.

Advantageously, the first drive surface and the second drive surface are each defined at least in part by rotating a generator line about an axis.

In a first variant, the first drive surface and the second drive surface are each defined entirely by rotating a generator line about an axis.

This first variant corresponds to the synchronization system described in the above-mentioned PCT Application.

In a second variant, at least one of the first and second drive surfaces presents at least one flat.

In which case, advantageously, the second drive surface is formed by the wall of a radial slot in the sliding disk or in a part that is stationary relative thereto, said slot being open on the side opposite from the second axis of rotation and presenting side faces that are substantially parallel to a radius intersecting the second axis of rotation, and whereas the first drive surface is formed on a lug integral with or secured to a coupling rod and engaged in said slot.

Such radial slots correspond to what is disclosed by GB 1,140,167. It should be noted that the above-mentioned flat is then formed by the side faces of said slots. However, such a flat can also be provided on second drive surfaces of different shapes, e.g. on surfaces having a substantially oval closed outline, with two diametrically opposite flats.

In an advantageous embodiment, the first drive surface is formed on an extension of a coupling rod beyond the second spherical joint, whereas the second drive surface is formed in a setback into which said extension is engaged.

In which case, advantageously, the setback is formed in the same part as the female portion of the second spherical joint and presents an axis of symmetry which is offset relative to the axis of said female portion.

The choice, for the first and second drive surfaces, of an extension to the coupling rod and of a setback is advantageous in that it makes machining and assembly easy. The offset setback can be formed easily by positioning a drill tool correctly. The coupling rod can be circularly symmetrical about its axis, which passes through the centers of the first and second spherical joints.

In another advantageous embodiment, the first drive surface is formed on a coupling rod between the first and second spherical joints, whereas the second drive surface is formed in a recess in a drive part which is stationary relative to the sliding disk, the coupling rod passing through said recess.

BRIEF DESCRIPTION OF THE DRAWINGS

The invention will be well understood and its advantages will appear more clearly on reading the following detailed description of embodiments given by way of non-limiting example. The description is given with reference to the accompanying drawings, in which.

MORE DETAILED DESCRIPTION

Figure 1:
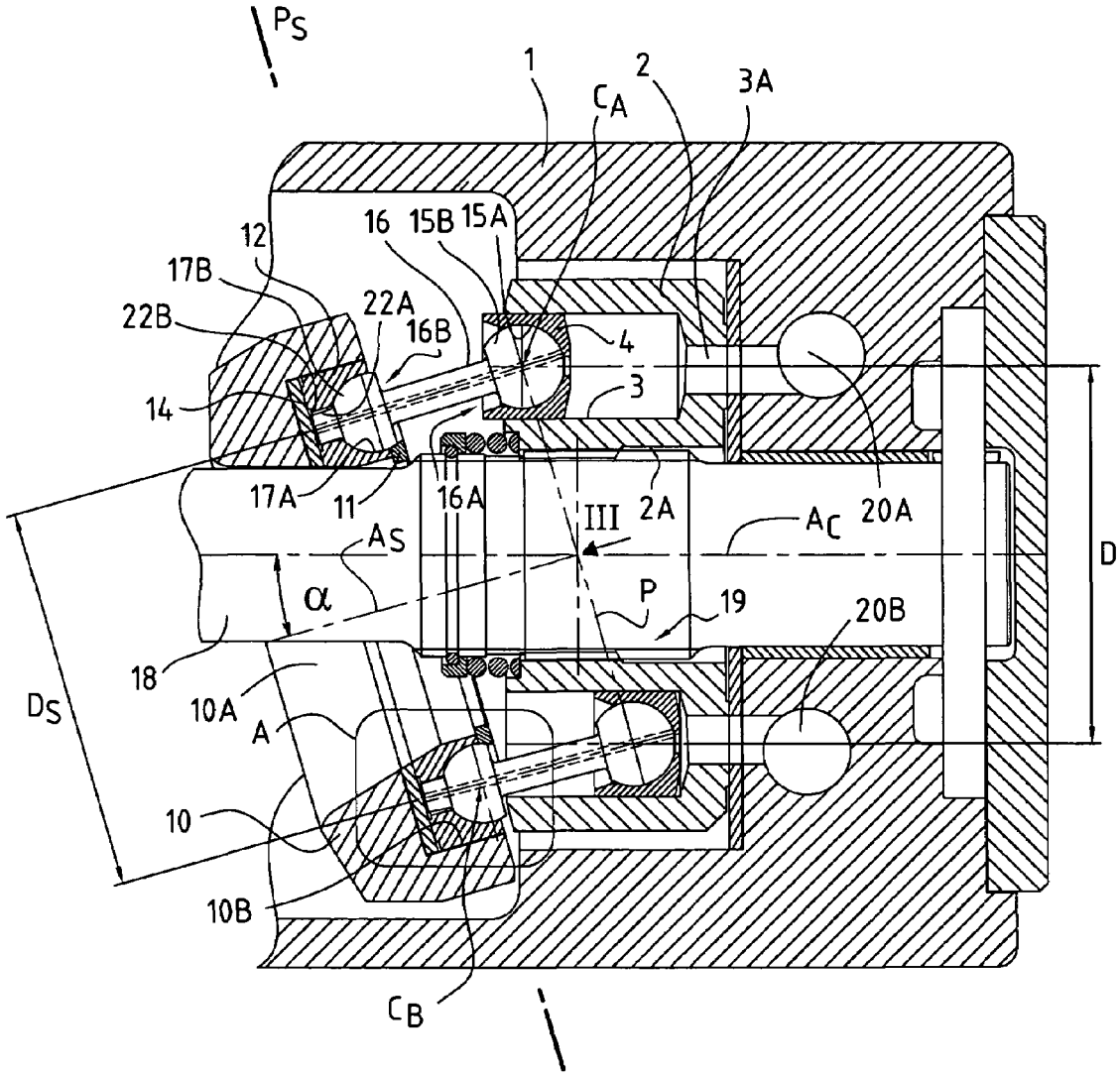
FIG. 1 is an axial section view through a first embodiment of a machine of the invention.

The hydraulic machine of FIG. 1 comprises a casing 1 in which a cylinder block 2 is disposed, the cylinder block being mounted to rotate about a first axis of rotation $A_C$. The cylinder block comprises a plurality of cylinders 3 in which pistons 4 are mounted to move in translation, parallel to the first axis of rotation $A_C$. Said machine further comprises a swash plate 10 which supports a sliding disk 12 via an axial bearing 14. The sliding disk can thus turn relative to the swash plate about a second axis of rotation $A_S$.

Coupling rods 16 extend between the sliding disk 12 and the pistons 14. More precisely, each coupling rod is connected to a piston via a first spherical joint 16A and to the sliding disk via a second spherical joint 16B. The first spherical joint comprises a female portion 15A recessed into the piston and open on its side closer to the swash plate, and a male head 15B integral with or secured to the coupling rod 16. Similarly, the second spherical joint comprises a female portion 17A recessed into the sliding disk and a male head 17B integral with or secured to the coupling rod 16.

The machine further comprises a shaft 18 which, depending on whether said machine is a pump or a motor, constitutes the inlet or the outlet of the machine. Said shaft is engaged in a bore 2A in the cylinder block, and is constrained to rotate therewith by means of complementary splines 19.

The machine further comprises feed and discharge main ducts 20A, 20B with which cylinder conducts 3A can be put into communication.

The second axis of rotation $A_S$ is inclined relative to the first axis $A_C$ at an angle $\alpha$. This angle can be adjustable in order to vary the cubic capacity of the machine. In FIG. 1, the angle of inclination is at its maximum, the shaft 18 being almost in contact with the wall of the through bore 10A in the swash plate 10. However, the invention also applies to machines for which said angle of inclination is constant, in particular motors having non-variable cubic capacities.

The axial bearing 14 is disposed at the end wall of a setback 10B provided in the swash plate, on its side facing towards the cylinder block, and the sliding disk 12 is also disposed in said setback. A retainer part 11 such as a ring segment makes it possible to retain the male heads of the second spherical joints 16B in the female portions of said spherical joints.

If it is considered that the machine is a motor, in view of the feed and of the discharge via the ducts 20A and 20B, the pistons 4 move in translation in the cylinders 3, and this, because of the inclination of the swash plate, causes the cylinder block to rotate. It can be understood that, during this rotation, the centers $C_A$ of the first spherical joints are moved over a cylinder having a circular base, whose diameter is D and whose axis is the first axis of rotation $A_C$. At the same time, the centers $C_B$ of the second spherical joints are moved over a circle centered on the second axis of rotation $A_S$ and having a diameter $D_S$. If the cylinder over which the centers of the first spherical joints move is projected onto the plane $P_S$ in which the centers of the second spherical joints lie, an ellipse is obtained that has a major axis D/cos $\alpha$ and a minor axis D.

The machine further comprises a synchronization system for providing synchronization between the cylinder block 2 and the sliding disk 12. This synchronization is achieved by means of the coupling rods. More precisely, for each coupling rod, the synchronization system comprises a first drive surface formed on an extension 22A of a coupling rod 16 beyond the second spherical joint 16B and a second drive surface formed in a setback 22B into which said extension or lug 22A is engaged.

In general, for each coupling rod, the first drive surface is stationary relative to the coupling rod, while the second drive surface with which it co-operates is stationary relative to the sliding disk. Thus, the first and second coupling surfaces can, as in this example, be formed integrally respectively with a coupling rod and with the sliding disk, or else they can be secured to those parts.

Figure 2:
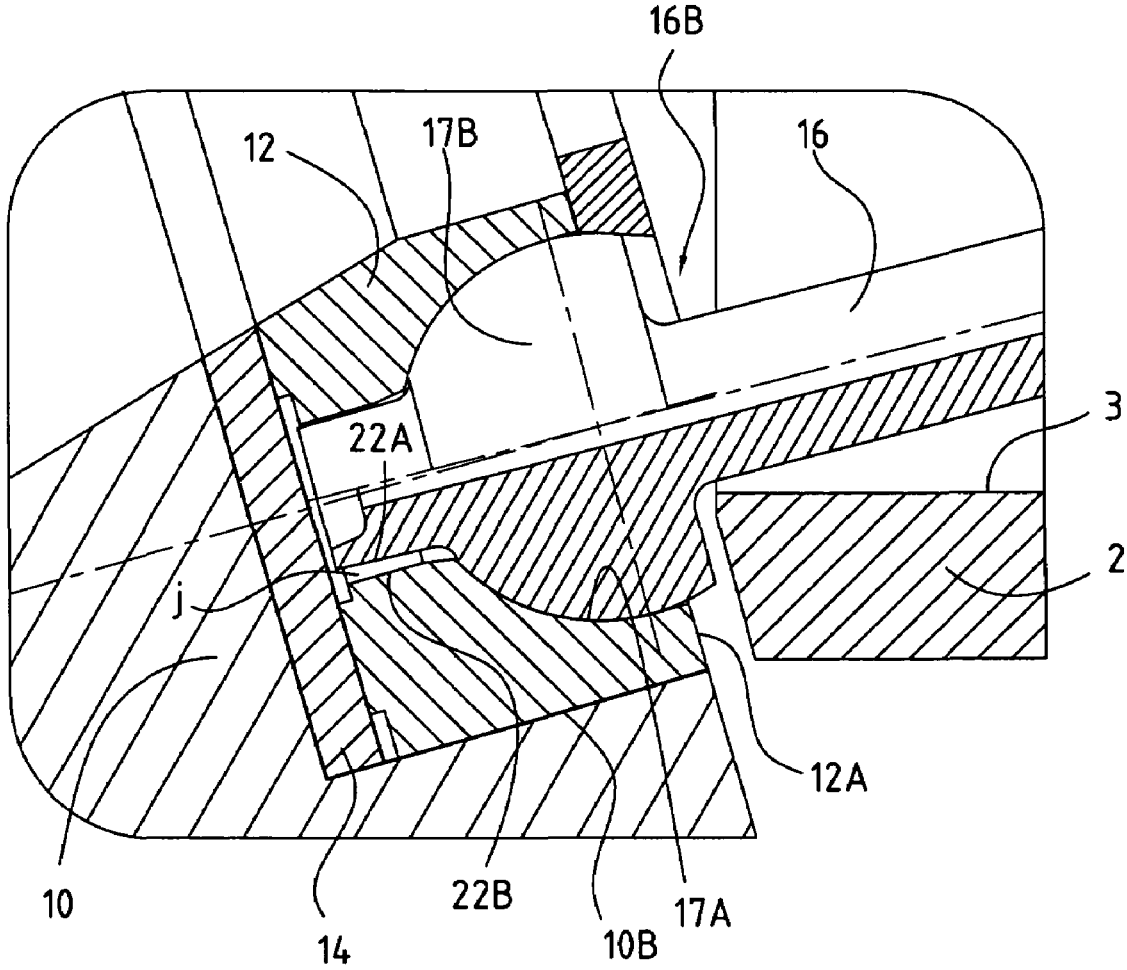
FIG. 2 is an enlargement of region A of FIG. 1.

As can be seen more clearly in FIG. 2, clearance j is provided between the first and second drive surfaces. This clearance is calculated so as to enable the coupling rods to pivot about the centers of the first spherical joints while the pistons are moving back and forth in the cylinders.

Figure 3:
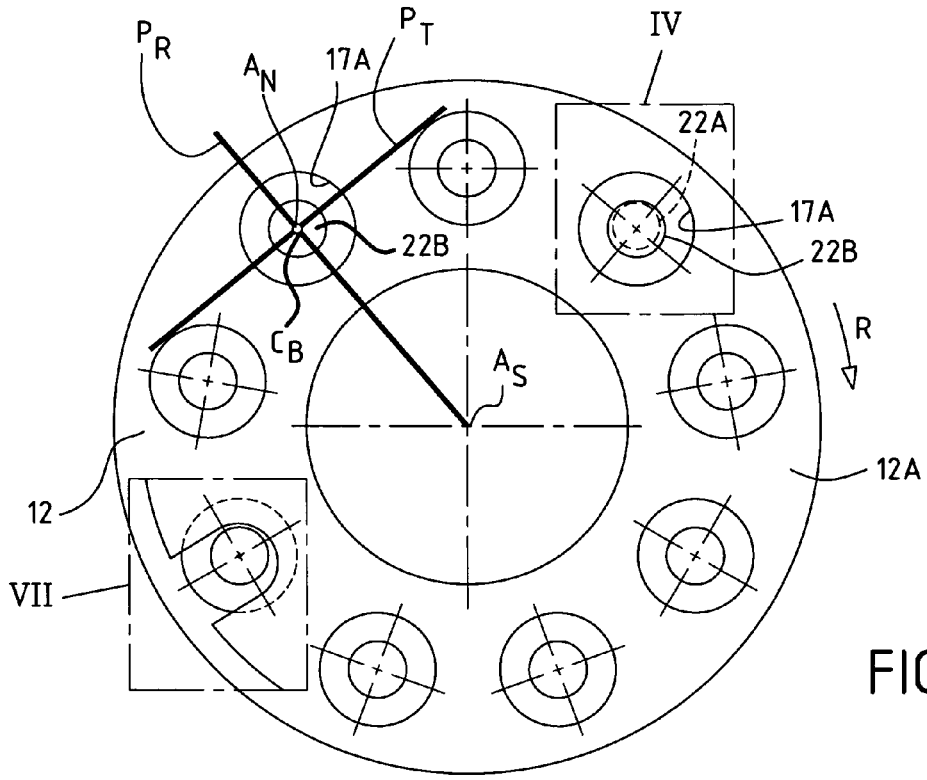
FIG. 3 shows the sliding disk, seen looking along arrow III of FIG. 1, which disk is parallel to the second axis of rotation, with portions modified so as to show two embodiments.

FIG. 3 shows the front face 12A of the sliding disk, which face faces towards the cylinder block 2. This view is seen looking perpendicular to the second axis of rotation $A_S$. This view shows the setbacks 17A forming the female portions of the second spherical joints, and the setbacks 22B in which the extensions 22A of the coupling rods are engaged. Portion IV of FIG. 3 is enlarged in FIG. 4 which corresponds to the first embodiment, while also showing, in chained-dotted lines, the reference position of such an extension 22A when the axis of the coupling rod coincides with the normal axis $A_N$ that passes through the center of the second spherical joint under consideration and is parallel to the second axis of rotation $A_S$. For one of the spherical joints, said normal axis $A_N$ is shown, as is the tangential plane $P_T$ and the radial plane $P_R$, which is the normal radial plane for the coupling rod corresponding to said second spherical joint. For a second spherical joint under consideration, the tangential plane $P_T$ is the plane that is tangential to the circle described by the center $C_B$ of said second spherical joint while the sliding disk is rotating about the axis $A_S$, whereas the radial plane $P_R$ is the plane that contains the second axis of rotation $A_S$ and a radial straight line intersecting said axis $A_S$ and passing through the center $C_B$ of the of the second spherical joint.

Figure 4:
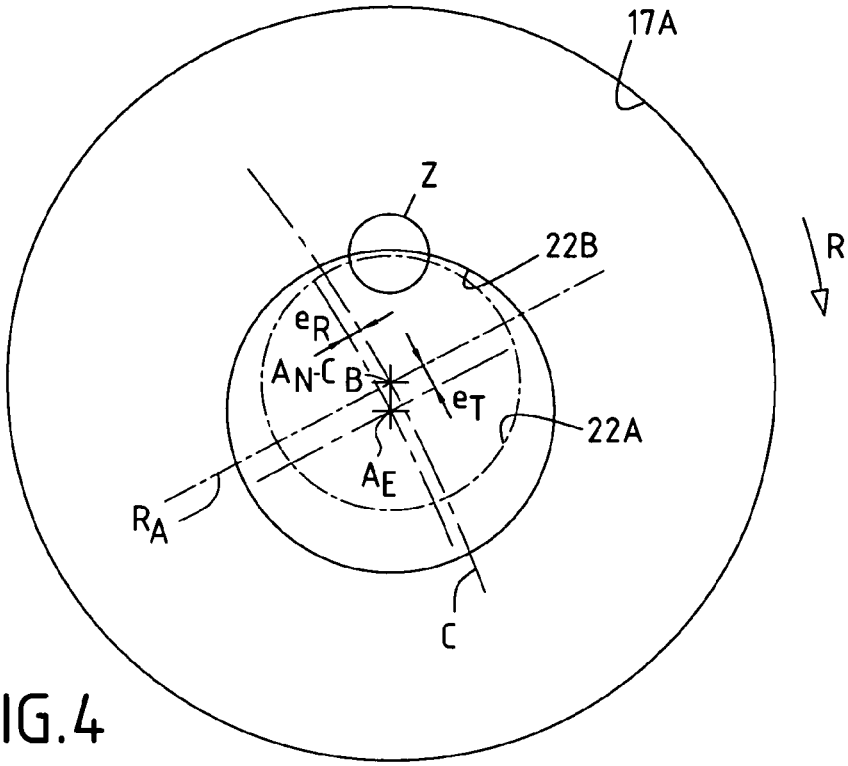
FIG. 4 is an enlargement of zone IV of FIG. 3, making it possible to show the first embodiment of the invention more clearly.

FIG. 4 shows that the second drive surface, which is formed in the setback 22B of the sliding disk is off-center relative to the center $C_B$ of the second spherical joint and of the extension 22A of the corresponding coupling rod. FIG. 4 shows the female portion 17A of the second spherical joint, with its center $C_B$ through which the normal axis $A_N$ passes. FIG. 4 also shows the reference position of the extension 22A of the coupling rod that co-operates with the setback 17B. The extension 22A is of circular section centered on the axis of the coupling rod. Thus, in FIG. 4, said extension is represented by a circle centered on the center $C_B$. The synchronization setback 22B in which the extension 22A is engaged is also represented by a circle, but that circle is off-center. The center $A_E$ of the circle forming the base of the cylindrical setback 22B is offset relative to the center $C_B$ with tangential eccentricity $e_T$ and radial eccentricity $e_R$.

The tangential eccentricity is measured tangentially to the circle C described by the center $C_B$ of the second spherical joint while the sliding disk is rotating about the second axis of rotation $A_S$.

The radial eccentricity $e_R$ is measured on a radius $R_A$ of the circle.

In FIG. 4, the extension 22A is in its defined reference position in which its axis is parallel to the second axis of rotation, and the offset between the circles 22A and 22B represents the "reference clearance" between the first drive surface and the second drive surface. It can be seen that the reference clearance is small in the zone Z in which the surfaces come into contact at the time of synchronization in the preferred direction of rotation, i.e. while the sliding disk is turning in the direction R, under the effect of the cylinder block rotating in the corresponding direction. In general, at the start of such a rotation, the coupling rods tend to tilt forwards so that the zone Z is situated in the vicinity of the back of the extension 22A as shown in FIGS. 3 and 4.

Figure 5:
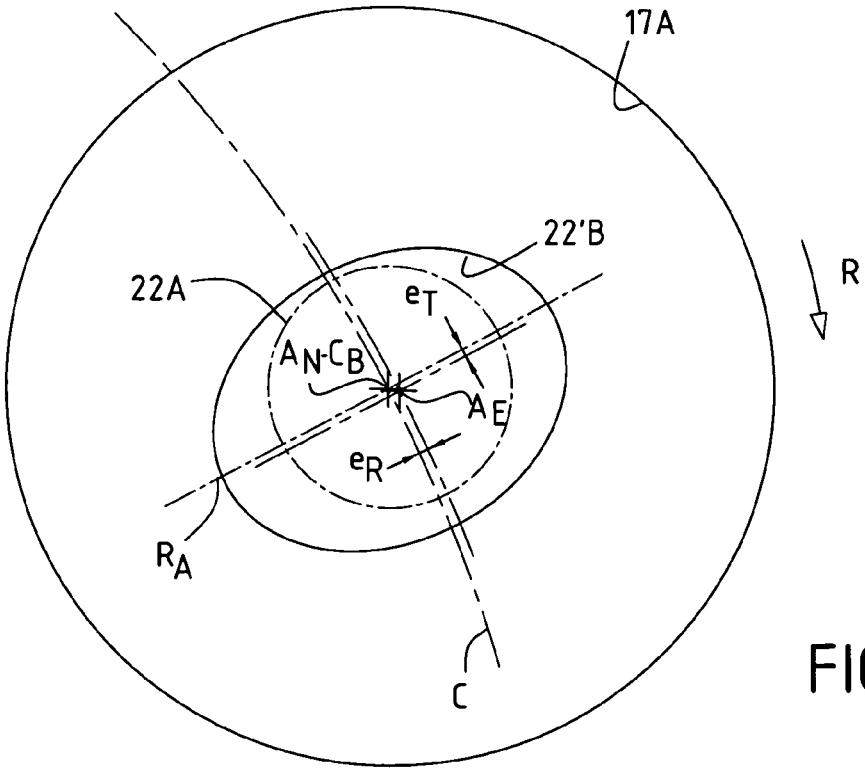
FIG. 5 is a view analogous to FIG. 4, for a variant embodiment.

In FIG. 4, the setback 22B is circularly cylindrical in shape. In the variant shown in FIG. 5, the setback 22'B is elliptical in shape. The center of the ellipse, indicated by the axis $A_E$, is formed at the intersection between the major axis and the minor axis of the ellipse and is also off-center relative to the center $C_B$ of the second spherical joint 17A. The radial and tangential eccentricities are measured in the same way as indicated above.

Figure 6:
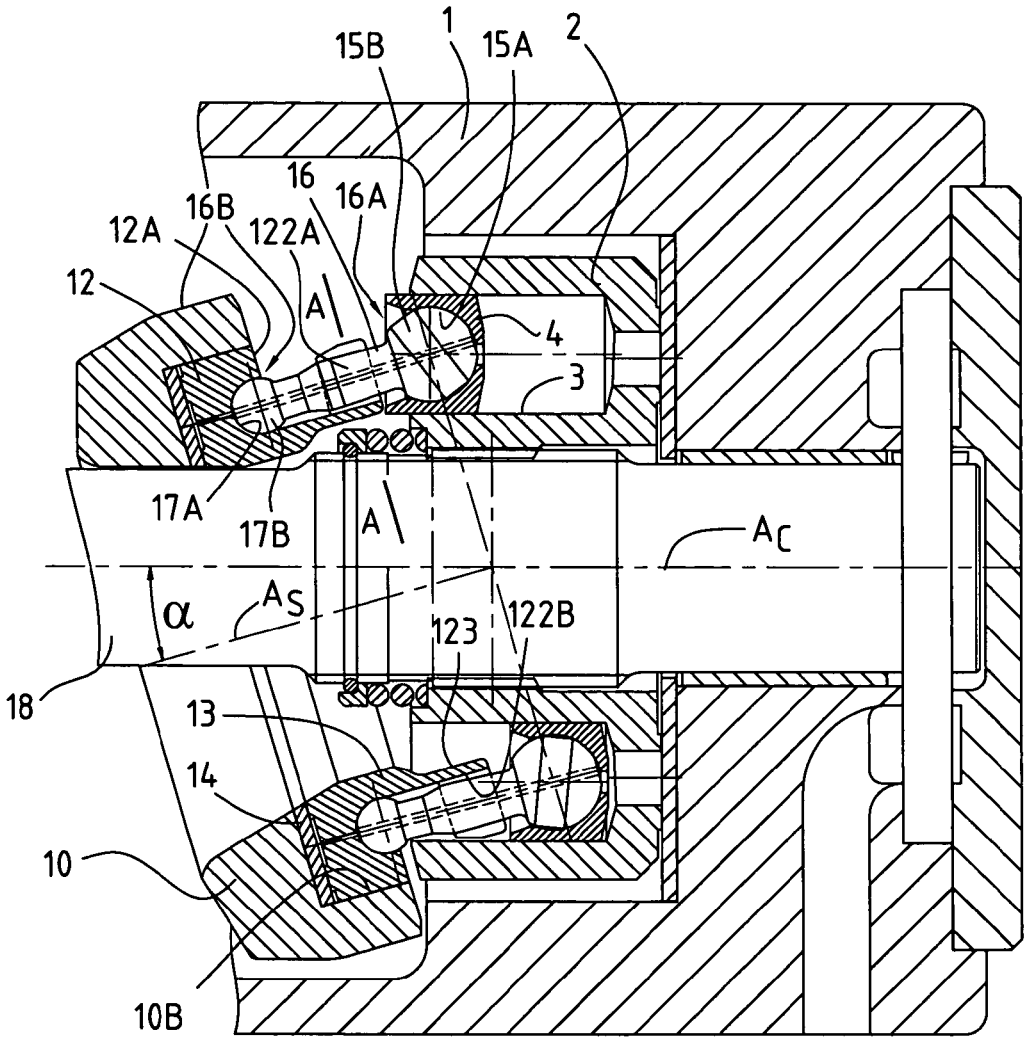
FIG. 6 is a view analogous to FIG. 1, showing a second embodiment.

FIG. 6 shows a second embodiment. The elements analogous to the elements of FIG. 1 are designated by like references. In FIG. 6, the second drive surface is formed by the wall of a radial slot in the sliding disk (or in a part that is stationary relative to said disk) and the first drive surface is formed on a lug integral with or secured to a coupling rod and engaged in said slot. The first drive surface for a coupling rod is formed on said rod, between the first and second spherical joints 16A and 16B, whereas the second drive surface is formed in a recess in a drive part that is stationary relative to the sliding disk.

More precisely, the first drive surface 122A is formed by the circularly cylindrical surface of a segment 122A of the coupling rod that forms a lug, between the two spherical joints. The sliding disk has a central extension 13 which extends from the front face 12A of said disk towards the cylinder block 2. The central extension carries a plurality of hollow fingers 123, one for each coupling rod, each of said fingers providing a recess 122B through which the coupling rod passes.

Thus, in this example, the recesses are formed integrally with the sliding disk. However, it should be noted that the extension 13 could be a separate part mounted on and fastened to the disk.

Figure 7:
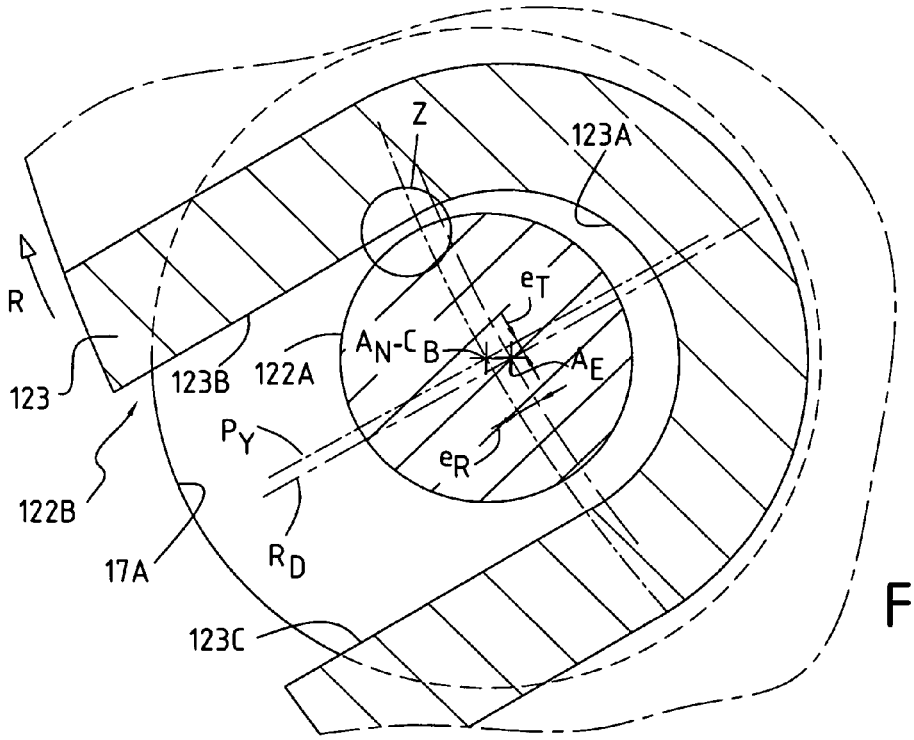
FIG. 7 is an enlargement of zone VII of FIG. 3, enabling the second embodiment to be better understood.

The second embodiment is shown in the detail VII of FIG. 3 and in the enlarged view of FIG. 7, which is a section A-A of FIG. 6. It can thus be observed that the recess 122B is in the form of a radial slot that is open on its side closer to the outer periphery of the sliding disk, i.e. on its side opposite from the second axis of rotation. Thus, the second drive surface 122B is formed by the wall of such a radial slot. Said slot presents two side faces, respectively 123B and 123C that are substantially parallel to a radius intersecting the second axis of rotation $A_S$. The end wall 123A of the slot 122B has the shape of a cylinder portion. Thus, in section A-A, it is represented by a semicircle.

In FIG. 7, the position of the center $C_B$ of the second spherical joint 17A is indicated. FIG. 7 shows the reference position in which the coupling rod 16 that carries the first drive surface 122A has its axis that coincides with the normal axis $A_N$ passing through the center $C_B$.

The slot 122B presents a plane of symmetry $P_Y$ which is substantially parallel to a radius intersecting the second axis of rotation $A_S$ and which is offset relative to a radius $R_D$ of the sliding disk 12 passing through the center $C_B$ of the female portion 17A of the second spherical joint connecting the coupling rod under consideration to the sliding disk. The plan $P_Y$ is offset relative to the axis $A_N$ of the female portion 17A of the spherical joint. As can be seen, said offset is such that the reference clearance between the lug 122A and the wall of the slot 122B which forms the second drive surface is small in the zone Z in which synchronization takes place while the cylinder block is rotating in the preferred direction R.

In this example, since the end-wall of the slot 122B is a cylinder portion, the center of curvature of said end-wall is represented by the axis $A_E$, and radial eccentricity and tangential eccentricity that are indicated in FIG. 7 are measured relative to said center of curvature.

The variant in which the second drive surface is formed by a radial slot open on its side opposite from the second axis of rotation is usable in the second embodiment as shown, and also when, in general, the first drive surface is formed on a lug integral with or secured to a coupling rod engaged in said slot. The lug can be disposed between the spherical joints as in FIGS. 6 and 7, or else it can be made in the form of an extension as in the first embodiment, in which case, the setback 10B in the swash plate and the sliding disk 12 could be open radially on the side opposite from the second axis of rotation $A_S$.

Advantageously, each of the first and the second drive surfaces are defined at least in part by rotating a generator line about an axis. This applies, for example, for the end wall 123A of the slot 122B in FIG. 7. In FIG. 7, the first drive surface is formed entirely by rotating a generator line about the axis of the coupling rod.

In FIG. 4, each of the two drive surfaces is defined entirely by rotating a generator line about an axis, as represented by the circles shown in FIG. 4.

In a variant, at least one of the first and second drive surfaces has, in section perpendicular to the second axis of rotation $A_S$, the shape of a curve whose curvature varies along the length of said curve. This applies, for example, for the second drive surface shown in FIG. 5, as represented by an ellipse 22'B.

As indicated, the curve can also be modified so as to have at least one flat.

In FIGS. 6 and 7, the slot on whose wall the second drive surface is formed is provided with two flats, formed by the two sides of said slot 123B, 123C. In FIGS. 1 to 5, the first and second drive surfaces have closed outlines. In FIGS. 6 and 7, only one of the surfaces, namely the second drive surface, has such a closed outline, while the other surface has an open outline.

The invention applies to a motor or else to a pump having axial pistons, having a preferred rotation direction. The motor or the pump can have a single rotation direction, in particular if it is the pump of an open circuit or of a motor having a single rotation direction. It can also have a reverse rotation direction which is used exceptionally, e.g. when in a motor for driving a vehicle in translation, for reverse gear.

For example, for a machine having nine piston-and-cylinder assemblies distributed uniformly, and having a cubic capacity of 70 $cm^3$, implemented in accordance with the first embodiment shown in FIGS. 1 to 4, it was observed that tangential eccentricity lying in the range 0.05° to 0.2°, while the ratio between the diameter of the extensions 22A and the diameter of the setbacks 22B was 0.921, made it possible to divide the synchronization tangential forces by about 5.

What is claimed is:

1. A hydraulic machine having axial pistons, such as a motor or a pump, comprising:

a cylinder block mounted in a casing to rotate about a first axis of rotation in a preferred direction of rotation, the cylinder block comprising a plurality of cylinders in which pistons are mounted to move in translation parallel to the first axis of rotation;

a swash plate supporting a sliding disk suitable for being driven, relative to the swash plate, in rotation about a second axis of rotation which is inclined relative to the first axis of rotation;

coupling rods for coupling together the sliding disk and the pistons, each coupling rod being connected firstly to a piston via a first spherical joint and secondly to the sliding disk via a second spherical joint; and a synchronization system for providing synchronization between the cylinder block and the sliding disk which, for each coupling rod, has a first drive surface that is stationary relative to the coupling rod and that is suitable for coming into contact with a second drive surface that is stationary relative to the sliding disk, clearance being provided between said first and second drive surfaces;

wherein the second drive surfaces are off-center relative to the second spherical joints such that a reference amount of clearance between a second drive surface and a first drive surface is small in the zone in which said surfaces come into contact at the time of synchronization in the preferred direction of rotation.

2. A machine according to claim 1, wherein, relative to the second spherical joints, the second drive surfaces present tangential eccentricity measured, for each second spherical joint, tangentially to the circle described by the center of said second spherical joint while the sliding disk is rotating about the second axis of rotation.

3. A machine according to claim 2, wherein, relative to the second spherical joints, the second drive surfaces also present radial eccentricity measured, for each second spherical joint, on a radius of the circle described by the center of said second spherical joint while the sliding disk is rotating about the second axis of rotation.

4. A machine according to claim 1, wherein the first drive surface and the second drive surface are each defined at least in part by rotating a generator line about an axis.

5. A machine according to claim 4, wherein the first drive surface and the second drive surface are each defined entirely by rotating a generator line about an axis.

6. A machine according to claim 1, wherein, in section perpendicular to the second axis of rotation, at least one of the first and second drive surfaces presents the shape of a curve whose curvature varies along said curve.

7. A machine according to claim 1, wherein at least one of the first and second drive surfaces presents at least one flat.

8. A machine according to claim 1, wherein at least one of the first and second drive surfaces presents a closed outline.

9. A machine according to claim 1, wherein at least one of the first and second drive surfaces presents an open outline.

10. A machine according to claim 9, wherein the second drive surface is formed by the wall of a radial slot in the sliding disk or in a part that is stationary relative thereto, said slot being open on the side opposite from the second axis of rotation and presenting side faces that are substantially parallel to a radius intersecting the second axis of rotation, and wherein the first drive surface is formed on a lug integral with or secured to a coupling rod and engaged in said slot.

11. A machine according to claim 10, wherein the slot presents a plane of symmetry that is substantially parallel to a radius intersecting the second axis of rotation and offset relative to a radius of the sliding disk that passes through the center of the female portion of the second spherical joint connecting the coupling rod to the sliding disk.

12. A machine according to claim 1, wherein the first drive surface is formed on an extension of a coupling rod beyond the second spherical joint, whereas the second drive surface is formed in a setback into which said extension is engaged.

13. A machine according to claim 12, wherein the setback is formed in the same part as the female portion of the second spherical joint and presents an axis of symmetry which is offset relative to the axis of said female portion.

14. A machine according to claim 1, wherein the first drive surface is formed on a coupling rod between the first and second spherical joints, whereas the second drive surface is formed in a recess in a drive part which is stationary relative to the sliding disk, the coupling rod passing through said recess.

15. A machine according to claim 14, wherein the recess co-operating with the first drive surface of a coupling rod presents an axis of symmetry that is offset relative to the axis of said female portion of the spherical joint via which the coupling rod is connected to the sliding disk.

* * * * *